US005273156A

United States Patent [19]

Harris

[11] Patent Number: 5,273,156

[45] Date of Patent: Dec. 28, 1993

[54] NECK CLIP BOTTLE CARRIER

[75] Inventor: Randall L. Harris, Powder Springs, Ga.

[73] Assignee: Riverwood International Corporation, Atlanta, Ga.

[21] Appl. No.: 61,881

[22] Filed: May 17, 1993

[51] Int. Cl.[5] ..... B65D 75/00; B65D 71/00

[52] U.S. Cl. ..... 206/147; 206/153

[58] Field of Search ..... 206/147, 145, 153

[56] References Cited

U.S. PATENT DOCUMENTS

| | | | |
|---|---|---|---|
| 3,640,563 | 2/1972 | Wood | 206/145 X |
| 3,860,281 | 1/1975 | Wood | 294/87.2 |
| 4,180,191 | 12/1979 | Wood | 206/147 X |
| 4,244,617 | 1/1981 | Manizza | 206/153 X |
| 4,318,476 | 3/1982 | Wood et al. | 206/153 X |
| 4,372,599 | 2/1983 | Kiedaisch et al. | 206/153 X |
| 4,621,734 | 11/1986 | Heijnen et al. | 206/153 |

*Primary Examiner*—William I. Price

[57] ABSTRACT

A neck clip bottle carrier having a handle panel extending up from the angled side panels. The lower edges of openings in the side panels engage the undersides of bottle flanges to support the bottles. The openings continue into the handle panel, and the upper edges also engage the undersides of the bottle flanges when the handle panel is folded down. This maintains the handle panel below the tops of the bottles to allow the carriers to be stacked. One of the openings extending into the handle panel is a handle opening. The upper edge of the handle opening is of arcuate shape in order to distribute lifting and carrying stresses into the side panels.

17 Claims, 3 Drawing Sheets

10
24
34
32
28
16
30
26
27
22
18
36
F
20
16
12
14
B
B
B 40
24
24

18
F
16
16
54
68
66
44
52
46
50
41
14
B
12
12

18
F
24
54
16
24
52
46
16
B
12
14
12

NECK CLIP BOTTLE CARRIER

FIELD OF THE INVENTION

This invention relates to bottle carriers of the neck clip type, wherein the bottles are supported at their necks by an elongated tube-like carrier. More particularly, it relates to a neck clip carrier with an improved handle panel locking means and an improved handle.

BACKGROUND OF THE INVENTION

Neck clip carriers are commonly used to carry beverage bottles, particularly large plastic bottles which are formed with a flange or collar on the neck just below the bottle cap. Openings in the bottom of the carrier permit the carrier to be moved down over the tops of the bottles to be packaged. The lower edges of openings in the side panels of the carrier engage the underside of the bottle flanges and support the bottles during lifting and carrying.

Normally, a neck clip carrier designed to carry two bottles is provided with finger holes in the side panels between the bottles. In this location the finger holes can readily be grasped and the bottles are balanced when the carrier is lifted. Problems are encountered, however, in carriers designed to carry three bottles. The middle bottle occupies the space in the center of the carrier where finger holes normally would be, forcing the finger holes to be located on either side of the bottle. This is not feasible where large size bottles are involved because the finger holes would be too far apart to be grasped.

Attempts have been made to provide a handle that extends up over the bottles to enable the handle to be centered, but the handles in these cases have not been entirely satisfactory. Because the handle panel extends up above the tops of the bottles, it interferes with the stacking of carriers for shipping and storage. In addition, the handle openings are often uncomfortable to the hand in use, offering a minimum of surface area to be grasped, with the result that the handle edges press into the hand. If the handle is made larger, however, the great amount of stress on the handle openings during use in combination with the proximity of the handle opening to the edge of the handle panel can make the handle panel vulnerable to tearing.

It is an object of the invention to provide a handle for a neck clip bottle carrier that can be used in a three-bottle, carrier. It is also an object to provide a handle of this type which is able to resist tearing and is comfortable to the hand.

BRIEF SUMMARY OF THE INVENTION

The invention is used in connection with a neck clip bottle carrier of the type having a bottom panel with openings therein for receiving the necks of bottles and angled side panels foldably connected to the bottom panel. The upper portions of the side panels contain openings for receiving the necks of bottles, with the lower edges of the openings engaging the underside of flanges on the bottle neck to support the bottles in the carrier. In addition to this conventional structure, a handle panel is foldably connected to the upper ends of the side panels and includes openings which together with the openings in the side panels form continuous openings in the side panels and handle panel.

At least one of the openings in the handle panel has an upper edge for engaging the underside of the flange on an associated bottle when the handle panel is folded down about the fold lines connecting the handle panel to the side panels, thereby holding the handle panel in folded position beneath the tops of the bottles in the carrier to permit stacking of carriers.

In accordance with the invention, one of the openings in the handle panel comprises a handle opening to be gripped when lifting and carrying the carrier. This is an especially effective design for neck clip carriers that support three bottles, since the handle opening can be centered without interference from the center bottle. By making the upper edge of the handle opening arcuately shaped in a downward direction, the handle opening is able to distribute lifting and carrying stresses to the lower part of the handle panel, where there is more material to resist the stresses. The handle opening is also able to be made larger and more comfortable to the user by this design, and preferably includes a plurality of tabs foldably connected to the arcuate edge of the handle opening for making the handle grip even more comfortable to use.

The carrier can be formed from a rectangular blank, with resulting economies of material usage, and may be designed to have side panels of two-ply construction for added strength.

The above and other aspects and benefits of the invention will readily be apparent from the more detailed description of the preferred embodiment of the invention which follows.

DETAILED DESCRIPTION OF THE PREFERRED EMBODIMENT

Figure 1:
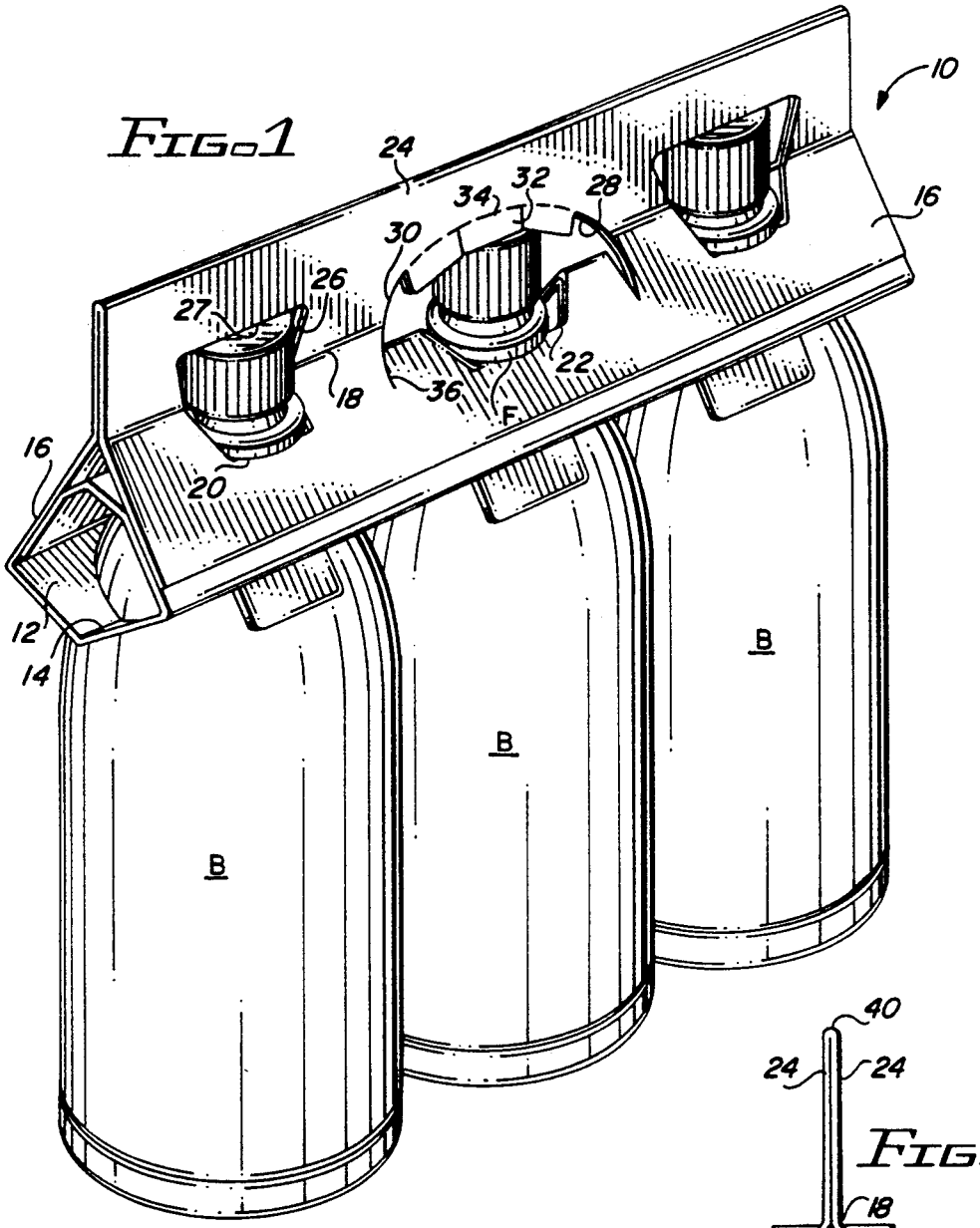
FIG. 1 is a pictorial view of the neck clip carrier of the invention, shown in supporting relationship with three bottles.
Figure 2:
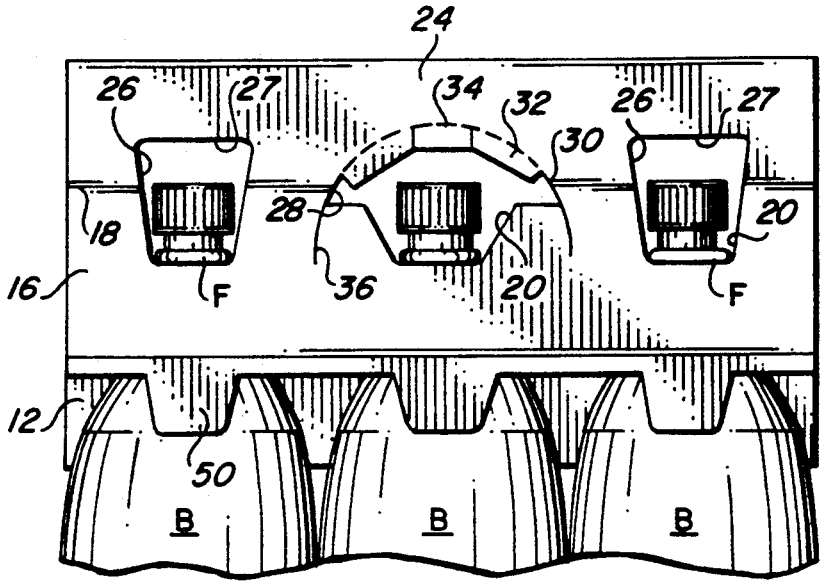
FIG. 2 is an enlarged partial side view of the neck clip carrier of FIG. 1.

Referring to FIGS. 1 and 2, the neck clip carrier 10 is illustrated in connection with a three-bottle arrangement. The carrier comprises a bottom panel 12 having cutouts which extend the full width of the bottom panel for receiving the bottles B. The bottom panel includes a fold line 14 extending down the center of the panel. Connected to the side edges of the bottom panel are side panels 16 which are angled toward each other, meeting at fold line 18. Each side panel includes a cutout 20 that interrupts the fold line 18 opposite the location of a bottle. Each cutout has a lower edge 22 that engages the underside of the flange F of a bottle when the carrier is lifted, thereby supporting the bottles.

The carrier also has a vertically extending handle panel 24 which is connected to the side panels along the fold line 18. The handle panel contains end cutouts 26 which interrupt the fold line 18 and open into the end cutouts 20 of the side panels to form combined openings in the side and handle panels. The upper extent of the handle panel end cutouts is defined by their upper edges 27, which serve a function explained more fully hereinafter.

Included in the handle panel is a center cutout 28 which also interrupts the fold line 18 and opens into the center cutout 20 of the side panels 16 to form a handle opening. The center cutout 28, which has a downwardly facing arcuate upper edge 30, is wider than the cutouts 26 and extends a sufficient distance into the handle panel to permit a person to insert his or her fingers through the handle opening in order to grip the handle panel when transporting the carrier. Tabs 32, connected to the arcuate edge of the handle opening along fold lines 34, fold under when a person grips the handle to cushion the grip and provide a double thickness of material at this point. It is necessary to provide several tabs for this function since a single longer tab would not be able to fold up along the arcuate edge.

The arcuate edge of the handle opening extends into the side panels, terminating in a slit 36. Lifting and carrying stresses are thereby distributed into the side panels, which are capable of withstanding the stresses and resisting tearing. The arcuate shape of the upper edge of the handle opening also adds strength to the handle, facilitating the distribution of stresses in the manner explained, and minimizes the distance that the handle opening is spaced from the upper edge of the handle panel so as to resist tearing between the upper edge of the handle opening and the top of the handle panel.

Figure 3:
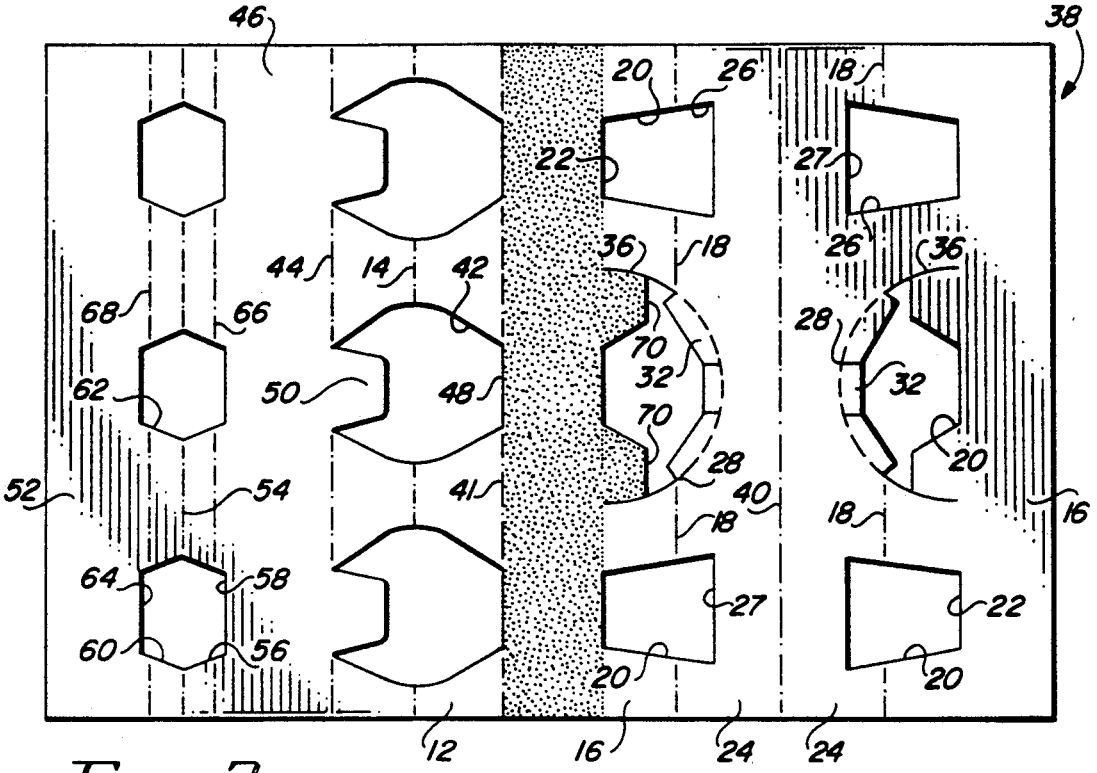
FIG. 3 is a plan view of a blank used to form the carrier.

Referring now to FIG. 3, wherein like reference numerals to those used in FIGS. 1 and 2 refer to similar elements, a blank 38 used to form the neck clip carrier of FIG. 1 is comprised of a rectangular sheet of flexible, foldable material such as conventional paperboard used in the carrier industry. One of the side panel sections 16 is located at the right side of the blank as viewed in FIG. 3 and is connected by the interrupted fold line 18 to a handle panel section 24. A similar handle panel section 24 is connected to the first handle panel section along continuous fold line 40, and is connected to a second side panel section 16, similar to the first, along a second interrupted fold line 18. The side panel sections 16 include the cutouts 20, and handle panel sections 24 include the cutouts 26 and 28, all shaped as described above.

The bottom panel 12 is connected at one edge to the interior side panel 16 along interrupted fold line 41, and includes openings 42 for receiving the upper portions of bottles supported by the carrier. The other edge of the bottom panel is connected along interrupted fold line 44 to a first inner side panel section 46. The openings 42 extend from one edge of the bottom panel to the other, and are shaped so as to terminate at one end in an edge 48 which substantially coincides with and interrupts the fold line 41. The other end of the openings 42 terminate in points at the fold line 44 at either side of tabs 50, which extend in from the adjacent first inner side panel section 46.

A second inner side panel section 52 located at the left side of the blank as viewed in FIG. 3 is connected to the section 46 along an interrupted fold line 54. Cutouts 56 in the inner side panel section 46, having edges 58, merge with similarly shaped cutouts 60 in the inner side panel section 52 to form openings 62 for receiving the necks of bottles supported in the carrier. The cutouts 60 include edges 64 which correspond to the edges 58. Fold lines 66 and 68 are provided parallel to the fold line 54 and are slightly spaced from the parallel edges 58 and 64 of the cutouts 56 and 60.

To form a carrier from the blank 38, the inner side panel section 52 is folded along fold line 54 to bring the inner side panel sections 52 and 46 into face-to-face contact. The left half of the bottom panel section 12 is then folded about the fold line 14 to bring the two halves of the bottom panel section into face-to-face contact. The inner side panel section 46 moves with the left half of the bottom panel section 12 as a unit, causing the inner side panel section 52, still in its folded position, to contact the interior side panel section 16. Glue applied to the stippled portion of the interior side panel section 16 adheres the inner side panel section to the section 16 in this area.

Figure 4:
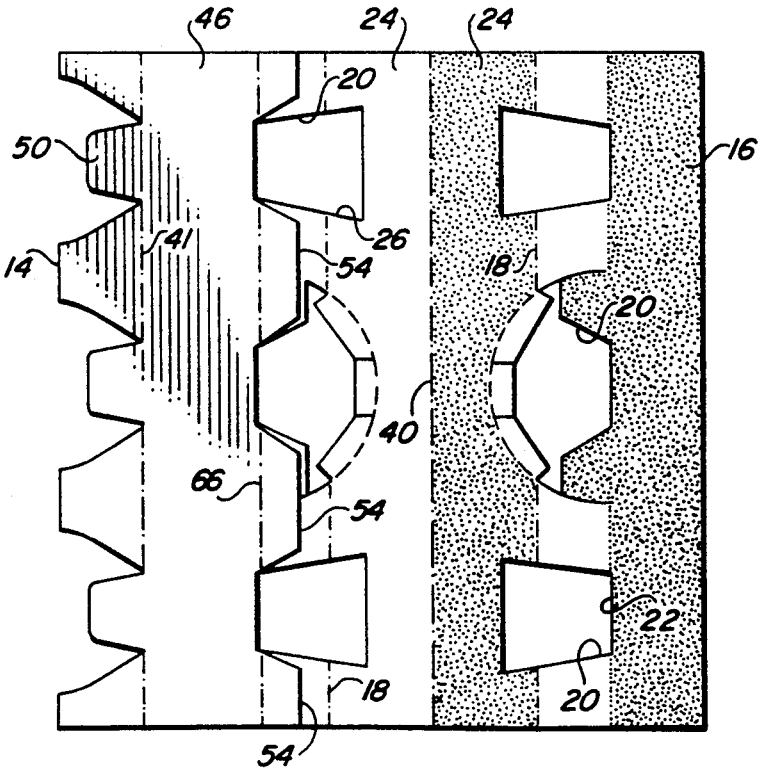
FIG. 4 is a plan view of the blank of FIG. 3 after it has been folded to an intermediate stage during formation of a carrier.

This operation results in the interim blank formation shown in FIG. 4, wherein the edges 58 and 64 of the cutouts 56 and 60 are aligned with the bottle flange support edges 22 of the interior side panel openings 20. Although the fold line 54 is shown as being aligned with the parallel edges 70 of the center side panel cutouts 20, they may be slightly offset without affecting the formation or functioning of the carrier. To complete the carrier, the handle section 24 shown at the right of the blank is folded about the fold line 40, bringing the handle sections together in face-to-face contact. This folding action also moves the side panel section 16 at the right of FIG. 4 into overlying contact with the inner side panel section 46. Glue applied in the stippled areas of the interim blank formation adheres the handle sections to each other and also the overlying side panel sections 16 and 46 to each other.

Figure 5:
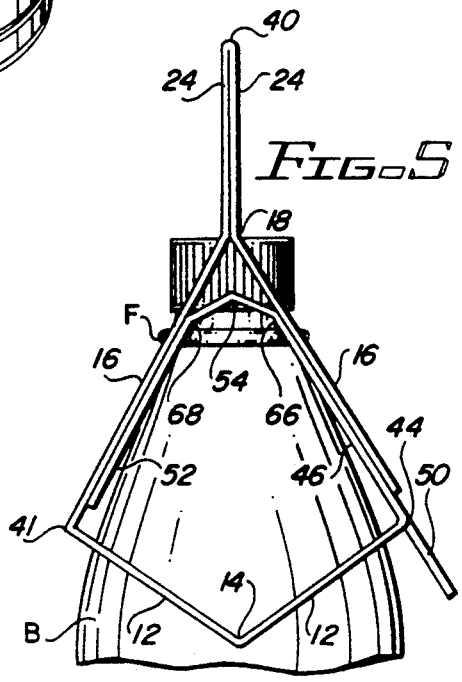
FIG. 5 is an enlarged partial end view of the carrier, illustrating the structure of the side panels.

The carrier is applied to bottles aligned with the openings in the carrier by moving the carrier down over the bottles so that the bottle necks move up through the bottom panel openings 42 and through the openings 62 in the inner side panels sections 46 and 52. The fold lines 14 in the bottom panel 12 and the fold lines 66 and 68 in the inner side panel sections 46 and 52 allow the side panels to flex away from each other as the bottles move up and force them out. The relative movement between the bottles and the carrier is continued until the flanges F on the bottles pass the lower locking edges 22 of the side panel cutouts, thereby allowing the side panels to snap into position beneath the flanges. This final locking arrangement is illustrated in FIGS. 1 and 5. The two-ply structure of the side panels formed by the side panel sections 16, 46 and 52 of the blank can be seen in FIG. 5. Also, the handle panel is shown in its normal vertical position, in which the handle opening is available to be grasped for lifting the carrier and attached bottles.

Figure 7:
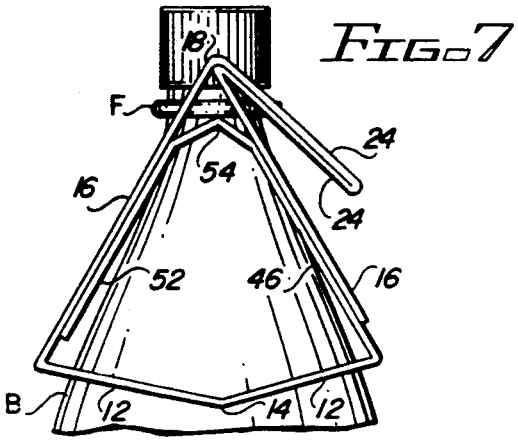
FIG. 7 is a partial end view of the carrier with the handle panel in locked folded position.
Figure 6:
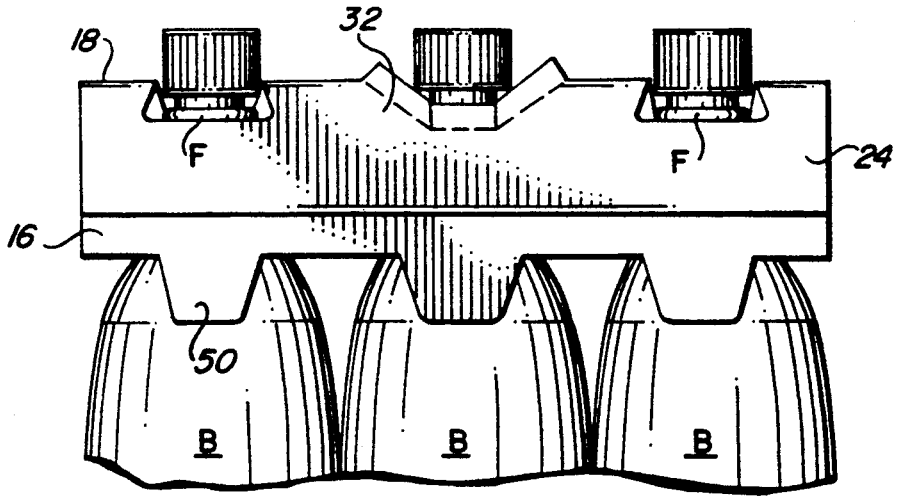
FIG. 6 is a partial side view of the carrier, shown with the handle panel in locked folded position.

As shown in FIG. 1, the end cutouts 26 in the handle panel 24 extend well up into the handle panel and, as previously noted, include an upper edge 27 which is parallel to the lower locking edge 22 of the cutouts 20 in the side panels. If it is desired to stack the carriers for shipping or storage, the handle panel can be folded down about the fold line 18 and locked in place by engaging the upper edges 27 of the end cutouts with the underside of the bottle flanges. Such an arrangement is illustrated in FIGS. 6 and 7. If desired, the cutouts 26 can be made large enough so that their upper edges 27 will engage the bottle flanges as a result of pivoting the handle panel down while the bottom edges 22 of the cutouts 20 remain in contact with the flanges. This is not the preferred arrangement, however, because the end cutouts 26 would have to be made so large in order to clear the bottle cap when the handle panel is pivoted down that the resulting thin strip of paperboard between the cutout edge and the upper edge of the handle panel would be more susceptible to tearing. Preferably, the carrier is pushed down a short distance over the upper portions of the bottles as the handle panel is pivoted down, so that the pivot point of the handle panel is moved down as well. This allows the end cutouts 26 to be kept small enough so that their upper edges can be spaced from the upper edge of the handle panel a distance that does not facilitate tearing. The slight downward movement of the carrier during this maneuver is made possible by the flexibility of the side panels and the bowing action of the bottom panel and the top of the inner side panels. The lower position of the fold line 18 in FIGS. 6 and 7 compared to its location in FIGS. 2 and 5 shows that the carrier has been pushed down slightly during pivoting of the handle panel toward its locked engagement with the flanges of the end bottles.

The action of the upper edges 27 of the end cutouts 26 with the bottle flanges is sufficient to hold the handle panel in its folded position below the tops of the bottles. No locking arrangement with the center bottle in the carrier is needed for this purpose. This enables the handle opening to be shaped differently from the end openings and makes it possible to design the handle opening for maximum strength and efficiency in as small a space as possible.

The upper edges 27 of the end cutouts in the handle panel preferably are wider than the lower edges 22 of the cutouts in the side panels. The relatively narrow lower edges result in the adjacent portions of the side edges of the side panel cutouts also engaging the bottle flanges, thus reducing slack in the fit of the carrier on the bottles which could otherwise permit the carrier to have limited sliding movement along its length. The relatively wide upper cutout edges 27 allow more leeway in maneuvering the handle panel into locking position.

The tabs 50 extending from the bottom of one of the side panels can be used to aid in removing bottles from the carrier. By pulling the tabs in an outwardly direction, the bottom panel and the strips adjacent the fold line 54 are straightened, causing the locking edges 22 of the side panel cutouts on the side of the carrier containing the tabs to move out from under the bottle flanges. The tabs can also be used to receive graphics or to act as coupons for use by a purchaser. Tabs could also be provided on the opposite side of the carrier if needed.

Although the invention has been illustrated in connection with bottles having flanges located at a point below the cap, it will be understood that the principles apply to other bottle designs as well, as long as they have a flange-like projection or shoulder which the locking edges of the cutouts can engage.

It should now be appreciated that the invention provides a positive means for locking a folded handle panel in place in order to prevent it from interfering with the stacking of installed carriers while at the same time providing a handle opening of improved strength that can be easily and comfortably gripped. The arcuate shape of the handle opening strengthens the handle panel against tearing, and the slits extending from the handle into the side panels further distribute stresses into the side panel where there is more material to take up the stresses. The use of foldable tabs connected to the arcuate handle edge additionally strengthens the handle and makes a more comfortable grip for the user.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A neck clip bottle carrier, comprising:

a bottom panel having openings therein for receiving the necks of bottles;

side panels connected to the bottom panel along fold lines, the side panels being angled toward each other;

a handle panel connected to the side panels along fold lines and extending upwardly therefrom;

openings in the upper portions of the side panels for receiving the necks of bottles, the openings including lower edges for engaging the undersides of outwardly extending flanges on the bottle necks to support the bottles in the carrier;

openings in the lower portions of the handle panel opening into the openings in the side panel; and at least one of the openings in the handle panel having an upper edge for engaging the underside of the outwardly extending flange on an associated bottle when the handle panel is folded down about the fold lines connecting the handle panel to the side panels, thereby holding the handle panel in folded position beneath the tops of the bottles in the carrier.

2. A neck clip bottle carrier as defined in claim 1, wherein the carrier includes openings for supporting three bottles, the outer two openings in the handle panel having upper edges for engaging the undersides of the outwardly extending flanges on associated bottles to hold the handle panel in folded position.

3. A neck clip bottle carrier as defined in claim 1, wherein the lower edges of the openings in the side panels are shorter than the upper edges of the openings in the handle panel.

4. A neck clip bottle carrier as defined in claim 2, wherein one of the openings in the handle panel comprises a handle opening to be gripped when lifting and carrying the carrier, the upper edge of said handle opening being arcuately shaped in a downward direction.

5. A neck clip bottle carrier as defined in claim 4, wherein the width of the arcuate edge is greater than the lower edge of the corresponding side panel openings.

6. A neck clip bottle carrier as defined in claim 5, including a plurality of tabs foldably connected to the arcuate edge of the handle opening.

7. A neck clip bottle carrier as defined in claim 1, wherein the side panels are of two-ply construction comprised of inner and outer plies in face-to-face relationship, the inner plies being connected to each other along fold lines in areas between the openings in the side panels, the fold lines connecting the side panels to the handle panel being in the outer plies.

8. A neck clip bottle carrier, comprising:

a bottom panel having openings therein for receiving the necks of bottles;

side panels connected to the bottom panel along fold lines, the side panels being angled toward each other;

a handle panel connected to the side panels along fold lines and extending upwardly therefrom;

openings in the upper portions of the side panels for receiving the necks of bottles, the openings including lower edges for .engaging the undersides of outwardly extending flanges on the bottle necks to support the bottles in the carrier;

openings in the lower portions of the handle panel opening into the openings in the side panel; and at least one of the openings in the handle panel comprises a handle opening to be gripped when lifting and carrying the carrier, the upper edge of said handle opening being arcuately shaped in a downward direction.

9. A neck clip bottle carrier as defined in claim 8, wherein the width of the arcuate edge is greater than the lower edge of the corresponding side panel openings.

10. A neck clip bottle carrier as defined in claim 9, including a plurality of tabs foldably connected to the arcuate edge of the handle opening.

11. A neck clip bottle carrier as defined in claim 8, wherein the ends of the arcuate edge of the handle opening terminate in the side panels.

12. A neck clip bottle carrier as defined in claim 11, wherein the ends of the arcuate edges of the handle opening are connected by slits to an intermediate portion of the side panels.

13. A substantially rectangular blank for forming a neck clip bottle carrier, comprising:

a first side panel section having an edge connected to a bottom panel section along a first fold line and an opposite edge connected to a first handle panel section along a second fold line;

a second handle panel section having an edge connected to the first handle panel section along a third fold line and an opposite edge connected to a second side panel section along a fourth fold line;

the first and second handle panel sections adapted to be adhered in face-to-face relationship to form the handle panel of a carrier formed from the blank;

the second side panel section adapted to be connected to be foldably connected to the bottom panel section, and the side panel sections adapted to be tapered toward each other in a carrier formed from the blank;

openings in adjoining portions of the side panel sections and the adjacent handle panel sections for receiving the necks of bottles in a carrier formed from the blank, each opening in the side panel sections having an edge for engaging the underside of an outwardly extending flange on an associated bottle neck to support the bottles in the carrier;

at least some of the openings in the handle panel sections having an edge for engaging the underside of the outwardly extending flange of an associated bottle when the handle panel is folded down about the second and fourth fold lines hold the handle panel in folded position beneath the tops of the bottles in the carrier.

14. A blank for forming a neck clip bottle carrier as defined in claim 13, wherein the edges of the openings in the side panel sections are shorter than the edges of the openings in the handle panel sections.

15. A blank for forming a neck clip bottle carrier as defined in claim 13, wherein a pair of openings in the handle panel sections which form a single opening in the handle panel of a carrier when the handle panel sections are in face-top-face relationship comprises a handle opening to be gripped when lifting and carrying the carrier, the edges of said openings which are adapted to be the upper edge of the handle opening in the handle panel of a carrier being arcuately shaped so as to extend downward in the carrier.

16. A blank for forming a neck clip bottle carrier as defined in claim 15, including a plurality of tabs foldably connected to the arcuate edges of said pair of openings.

17. A blank for forming a neck clip bottle carrier as defined in claim 13, including a third side panel section connected to an edge of the bottom panel section along a fifth fold line, and a fourth side panel section connected to an edge of the third side panel section along a sixth fold line, the third and fourth side panel sections having openings therein adjoining at the sixth fold line for receiving the necks of bottles, the third and fourth side panel sections adapted to be adhered together in face-to face relationship when folded about the sixth fold line and the opposite face of the third side panel section adapted to be adhered to the first side panel section so that the side panels of a carrier formed from the blank are comprised of two plies of material.

* * * * *